United States Patent [19]

LaConti et al.

[11] Patent Number: 4,457,823

[45] Date of Patent: Jul. 3, 1984

[54] THERMALLY STABILIZED REDUCED PLATINUM OXIDE ELECTROCATALYST

[75] Inventors: Anthony B. LaConti, Lynnfield; Russell M. Dempsey, Hamilton; Thomas G. Coker, Waltham, all of Mass.

[73] Assignee: General Electric Company, Schenectady, N.Y.

[21] Appl. No.: 225,940

[22] Filed: Jan. 19, 1981

Related U.S. Application Data

[63] Continuation of Ser. No. 931,419, Aug. 7, 1978, abandoned.

[51] Int. Cl.[3] ..... C25B 13/00; C25C 7/04

[52] U.S. Cl. ..... 204/282; 204/292; 204/294; 502/185; 502/325; 502/339

[58] Field of Search ..... 204/291, 282, 292, 294; 502/185, 325, 339

[56] References Cited

U.S. PATENT DOCUMENTS

| | | | |
|---|---|---|---|
| 3,134,696 | 5/1964 | Douglas et al. | 429/30 |
| 3,632,498 | 1/1972 | Beer | 204/290 F |
| 3,846,273 | 11/1974 | Bianchi et al. | 204/290 F |
| 3,857,760 | 12/1974 | Breuer et al. | 204/1 T |
| 3,992,271 | 11/1976 | Danzig et al. | 204/129 |
| 4,017,663 | 4/1977 | Breault | 429/12 |
| 4,032,427 | 6/1977 | Kadija | 204/283 |
| 4,057,479 | 11/1977 | Campbell | 204/258 |
| 4,118,294 | 10/1978 | Pellegri | 204/129 |
| 4,120,772 | 10/1978 | Kadija | 204/252 |

FOREIGN PATENT DOCUMENTS

| | | | |
|---|---|---|---|
| 1147442 | 4/1969 | United Kingdom | 204/290 F |

*Primary Examiner*—John F. Niebling
*Attorney, Agent, or Firm*—I. David Blumenfeld

[57] ABSTRACT

A novel, electrocatalytic material comprising at least one reduced platinum group metal oxide is subsequently heated in the presence of oxygen at a temperature high enough to stabilize the catalyst in acidic and halogen environments. The catalyst optionally contains other thermally stabilized, reduced platinum group metal oxides, electroconductive extenders of the group consisting of graphite and oxides of transition or valve metals. A novel electrode structure includes the catalyst and a polymeric binder. A novel method of preparing the electrocatalytic material is described as well as a unitary electrolyte electrode structure which has a bonded electrode containing the novel electrocatalytic material, bonded to at least one side of a membrane-electrolyte.

16 Claims, 2 Drawing Figures

THERMALLY STABILIZED REDUCED PLATINUM OXIDE ELECTROCATALYST

This is a continuation, of application Ser. No. 931,419, filed Aug. 7, 1978 abandoned.

The instant invention relates to a electrocatalyst, a catalytic electrode, and a membrane/electrode assembly. More particularly, it relates to catalysts and electrodes which are particularly useful in the electrolysis of halides.

Generating gas by electrolyzing a chemical compound into its constituent elements, one of which may be a gas, is, of course, an old and well known technique. One recently developed form of such gas evolving electrolyzer involves the use of a cell which utilizes an electrolyte in the form of a solid polymer, ion-exchanging membrane. In an arrangement of this sort, catalytic electrodes using a suitable catalyst are positioned on opposite sides of an ion transporting membrane medium such as a sulfonated perfluorocarbon ion-exchange membrane. Through an oxidation reaction, the ionic form of one of the constituent elements (hydrogen ions, for example, when $H_2O$ or HCl is electrolyzed, or sodium ions when an alkali metal halide such as sodium chloride is electrolyzed) is produced at one electrode. The ion is transported across the ion-exchanging membrane to the other electrode where it is reduced to form an electrolysis product such as molecular hydrogen, NaOH, etc. Solid polymer ion-exchange membranes electrolysis units are particularly advantageous because they are efficient, small in size, and do not utilize any corrosive liquid electrolytes.

Various metal and alloys have been utilized in the past as part of the catalytic electrodes associated with such electrochemical electrolyzing cells. The performance of the catalyst at the gas evolving electrodes is obviously crucial in determining the effectiveness and efficiency of the cell, and consequently of the economics of the process. The choice of a catalyst in an electrochemical cell and its effectiveness depends upon a complex set of variables, such as surface area of a catalyst, availability of oxides of its species on the catalyst surface, contaminants in the reactants, and the nature of the conversion taking place in the cell. Consequently, it is, and always has been, difficult to predict the applicability of a catalyst useful in one electrochemical cell to a different system. A commonly assigned U.S. Pat. No. 3,992,271 entitled "Methods and Apparatus for Gas Generation" describes an improved oxygen evolving catalytic electrode utilizing a platinum-iridium alloy, a mixture which was found to provide much improved performance and efficiency. Another commonly assigned U.S. Pat. No. 4,039,490 describes another oxygen evolving catalytic electrode which utilizes reduced oxides of platinum-ruthenium. The platinum-ruthenium catalyst not only is substantially less expensive than the reduced platinum-iridium catalyst, because it uses a less expensive material such as ruthenium to alloy with the platinum, but it also turns out to be more efficient because it has a lower oxygen overvoltage than a platinum-iridium electrode.

However, attempts to use reduced ruthenium oxide electrocatalysts for evolution of halogens by electrolysis of aqueous halide solutions have not been entirely successful due to the harsh electrolysis conditions in the cell. There can be substantial loss of catalyst from the membrane during chlorine evolution since these reduced platinum metal oxides are susceptible to dissolution in acidic environments which are present in the electrolysis of hydrogen halides or in the electrolysis of alkali metal halide solutions which are often acidified. Not only is there a tendency to dissolution of the platinum metals resulting in a loss of a catalytic material, but the overvoltage of the electrodes also tends to increase so that the efficiency of the cell decreases, and in many instances does not permit prolonged periods of operation.

It is, therefore, an object of the invention to provide a novel electrocatalytic material especially useful for the electrolysis of aqueous solutions of halide ions and to a novel process for the preparation of said catalytic material.

Another object of the invention is to provide a novel membrane/electrode structure in which a solid polymer electrolyte membrane has a catalytic electrode including the said electrocatalytic material bonded to at least one side of the membrane.

An additional object of the invention is to provide a novel, bonded electrode structure which includes the said electrocatalytic material which is bonded with a polymeric binder.

Still another object of the invention is to provide a novel electrolysis cell wherein the anode and cathode compartments are separated by a solid polymer electrolyte membrane having a coating of the novel electrocatalytic material bonded to at least one surface of the membrane.

Other objects and advantages of the invention will become apparent as the description thereof proceeds.

In accordance with the invention, the novel electrocatalyst comprises at least one reduced platinum group metal oxide which is subsequently treated in the presence of oxygen at a temperature high enough to stabilize the oxide thermally to increase the resistance of the catalyst against the corrosive electrolysis conditions. The catalytic, reduced platinum group metal oxide may optionally contain other reduced platinum group metal oxides such as iridium and optionally up to fifty (50) percent by weight of the electroconductive extenders such as graphite, valve metal oxides, transition metal oxides, and nitrides, carbides, and sulfides. Examples of useful platinum group metals are platinum, palladium, iridium, rhodium, ruthenium, and osmium with the preferred reduced metal oxide for chlorine and other halogen production being thermally stabilized, reduced oxides of ruthenium. Reduced oxides of ruthenium are preferred because they are found to have extremely low chlorine overvoltages as well as their stability in the electrolysis environment.

As pointed out above, the electrocatalytic material may be a single reduced platinum group metal oxide such as ruthenium oxide, or platinum oxide, or iridium oxide, etc. It has been found, however, that mixtures or alloys of thermally stabilized, reduced platinum group metal oxides are even more stable. One such mixture or alloy of ruthenium oxide containing up to twenty-five (25) percent of iridium oxide, with the preferred range being five (5) to twenty-five (25) percent by weight calculated as metal, even through iridium is somewhat more expensive than ruthenium alone.

Electroconductive extenders such as graphite have low overvoltages for halogens and are substantially less expensive than the platinum metal oxides and may readily be incorporated without reducing the effectiveness of the catalyst. In addition to graphite, oxides of valve metal such as titanium, tantalum, niobium, tungsten, venadium, zirconium, and hafnium may be added to further stabilize the electrocatalyst and increase its resistance against adverse electrolysis conditions.

The thermally stabilized, reduced platinum metal oxides and the extenders thereto formed into an electrode by bonding with fluorocarbon resin particles such as those sold by Dupont under its trade designation Teflon. The catalytic particles and resin particles are mixed, placed in a mold and heated until the composition is sintered into a suitable form which is bonded to at least one surface of the membrane by application of heat and pressure to provide an electrode structure and a unitary membrane/electrode structure.

The novel process for the preparation of the electrocatalyst comprises forming oxides of at least one platinum group metal along with one or more extenders such as graphite, valve metals, reducing the oxide to a partially oxidized state and then heating the latter in the presence of oxygen at a temperature which is sufficiently high to stabilize the reduced oxides.

The novel features which are believed to be characteristic of this invention are set forth with particularity in the appended claims. The invention itself, however, both as to its organization and method of operation, together with further objects and advantages thereof, may best be understood by reference to the following description taken in conjunction with the accompanying drawings in which:

Figure 1:
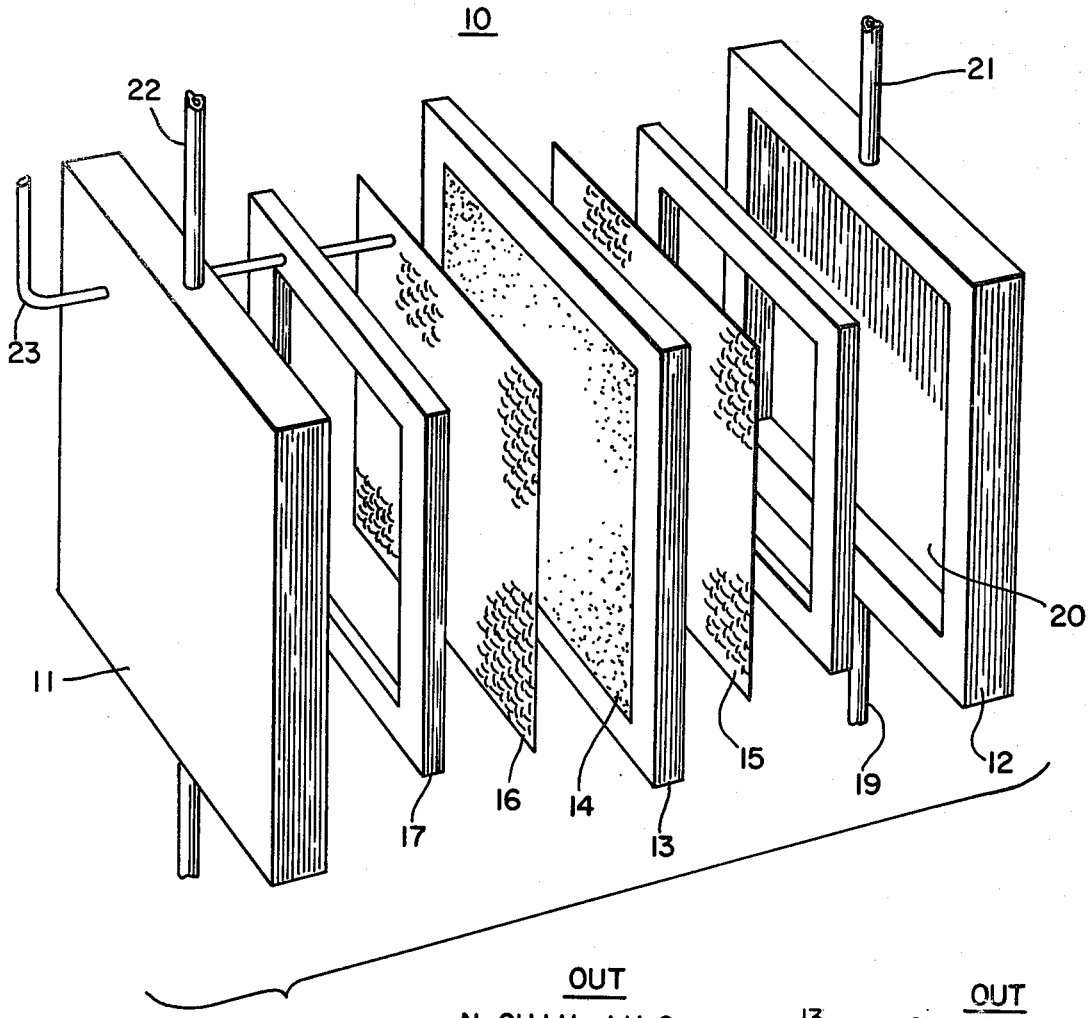
FIG. 1 is a schematic illustration of an electrolysis cell in accordance with the invention utilizing a solid polymer electrolyte membrane and novel catalyst bonded to the surface thereof.

The novel electrocatalyst which includes thermally stabilized, reduced oxides of a platinum group metal alone or in combination with other platinum group metals or optional valve metals may be prepared in any convenient fashion whereby an oxide catalyst is permanent, partially reduced and thermally stabilized.

The preferred manner of reduction is by a modification of the Adams method of platinum preparation by the addition of a thermally decomposable platinum halide, such as ruthenium chloride, either alone or, if desired, along with an appropriate quantity of other thermally decomposable halides of platinum metals or valve metals to an excess of sodium nitrate. The Adams method of platinum preparation is disclosed in an article published in 1923 by R. Adams and R. L. Schriner in the Journal of the American Chemical Society, Volume 45, Page 217. It is convenient to mix the finely divided halide salts of the platinum metals, such as Chloroplatinic acids in the case of platinum, ruthenium chloride in the case of ruthenium, titanium chloride, tantalum chloride, in the case of titanium and tantalum in the same weight ratio of the metals as desired in the final alloy mixture. An excess of sodium nitrate is incorporated and the mixture is fused in a silica dish at 500° to 600° C. for three (3) hours. The residue is washed thoroughly to remove nitrates and halides still present, leaving a residue of the desired platinum metal oxide, i.e., ruthenium oxide, platinum-ruthenium oxide, ruthenium-iridium oxide, ruthenium-titanium oxide, etc. The resulting suspension of mixed and alloyed oxides is then partially reduced. The reduction of the platinum group metal oxides may be effected by any convenient known reducing method, such as an electrochemical reduction or by bubbling hydrogen through the mixture at room temperature as long as the oxides are not to be completely reduced to the free metal form. In a preferred embodiment, oxides are reduced by using an electrochemical reduction technique, i.e., electrochemical reduction in an acid medium. The product which is now a reduced platinum metal oxide, either alone or as a mixed alloy oxide, is dried thoroughly, such as by the use of a heat lamp, ground, and then sieved through a 400 mesh nylon screen to produce a fine powder of the reduced platinum metal oxide.

The resulting reduced platinum metal oxides are then stabilized thermally by the heating in the presence of oxygen for a sufficient time to ensure a catalytic material which is stable in an acidic hydrogen halide environment and in the presence of halogens. In a manner to be described subsequently, thermal stabilization of the catalyst results in a catalyst which has much better corrosion characteristics in halogens, such as chlorine, etc., and in the presence of halides solutions such as hydrochloric, etc., acids. It is believed that thermal stabilization results in the formation of a catalytic particle having a large mean pore diameter and stable thin oxide film on the outside of the reduced oxide particle. This stabilizes the reduced oxide particles so that they have better mechanical properties for bonding to the solid polymer electrolyte membrane, and in their resistance characteristics to dissolution in hydrochloric acid or other halide acid solutions or to the evolved halogens. Thus, preferably, the reduced oxides are heated at 350° to 750° C. from thirty (30) minutes to six (6) hours with the preferable thermal stabilization procedure being accomplished by heating the reduced oxides for one (1) hour at 550° to 600° C.

It has also been found that the electrocatalytic activity of the catalyst and of the electrode including the catalyst is optimized by providing the catalytic particles in as find a powder form as possible. Thus, it has been found that the surface area of the particles, as observed both by the BET nitrogen absorption method, should be at least 25 meters square per gram of catalyst ($M^2/g$). The preferred range is 50 to $150M^2/g$.

The gas permeable electrode structure of catalytic particles and fluorocarbon polymer particles is produced by blending the catalytic particles with a Teflon dispersion to produce a bonded electrode structure in the manner described in U.S. Pat. No. 3,297,484 assigned to the assignee of the present invention. In the process of bonding the electrode, it is desirable to blend the catalyst with Teflon dispersions in such a manner that the dispersion contains little or no hydrocarbons. If the fluorocarbon Teflon composition contains hydrocarbon organic surface active agents, it results in loss of surface area of the reduced oxide catalyst. Any reduction on the surface area of the catalyst is obviously undesirable, since it has potentially deleterious effect on the efficiency and effectiveness of the catalyst. Hence, fabrication of the electrode should be by the use of a Teflon polytetrafluoroethylene particle composition which contains few, if any, hydrocarbons. One suitable form of these particles which may be utilized in fabricating the electrode is sold by Dupont under its designation Teflon T-30.

The mixture of noble metal particles and Teflon particles or of graphite and the reduced oxide particles are placed in a mold and heated until the composition is formed into a decal which is then bonded and embedded in the surface by the application of pressure and heat. As described, for example, in U.S. Pat. No. 3,297,484 above, the electrode structure is bonded to the surface of the ion-exchange membrane thus integrally bonding the gas absorbing particle mixture and, in some instances, preferably embedding it into the surface of the membrane.

The novel membrane/electrode structure thus fabricated comprises a solid polymer electrolyte membrane capable of selective ion transport having a thin, porous, gas permeable electrode of the above-described electrocatalytic reduced platinum group metal oxides bonded to at least one side of the membrane. A second electrode may be bonded to the other side of the membrane and may include the same electrocatalytic material, or any other suitable cathodic material. The selective ion transporting membrane is preferably a stable, hydrated, cationic membrane which is characterized by ion transport selectivity. The cation exchange membrane allows passage of positively charged cations such as hydrogen ions in the case of the electrolysis of a halide such as hydrogren chloride or sodium cations in the case of the electrolysis of aqueous alkali metal halides, and thus minimizes passage of negatively charged anions.

There are various types of ion exchange resins which may be fabricated into membranes to provide selective transport of the cations. Two classes of such resins are the so-called sulfonic acid cation exchange resins and the carboxylic cation exchange resins. Sulfonic acid exchange resins, which are the preferred type, include ion-exchange groups in the form of hydrated, sulfonic acid radicals ($SO_3H \times H_2O$) attached to the polymer backbone by sulfonation. The ion exchanging acid radicals in the membrane are fixedly attached to the backbone of the polymer ensuring that the electrolyte concentration does not vary. As pointed out previously, perfluorocarbon sulfonic acid cation membranes are preferred. One specific class of cation polymer membranes in this category is sold by the Dupont Company under its trade designation "Nafion". These "Nafion" membranes are hydrated, copolymers of polytetrafluoroethylene (PTFE) and polysulfonyl fluoride vinyl ether containing pendant sulfonic acid groups.

The ion-exchange capacity (IEC) of a given sulfonic cation exchange membrane is dependent upon the milliequivalent weight (MEW) of the $SO_3$ radical per gram of dry polymer. The greater the concentration of the sulfonic acid radicals, the greater the ion-exchange capacity and hence the capability of the membrane to transport cations. However, as the ion-exchange capacity of the membrane increases, so does the water content and the ability of the membrane to reject salt decreases. Thus in electrolysis of alkali metal halide solutions, caustic is generated at the cathode side and the rate at which the sodium hydroxide migrates from the cathode to the anode side thus increases with IEC. Such back migration reduces the cathodic current efficiency (CE) and also results in oxygen generation at the anode which have undesirable consequences in its effect on the catalytic anode electrode. Consequently, the preferred ion-exchange membrane for use in brine electrolysis is a laminate consisting of a thin (2 mil or so) film of fifteen hundred (1500) MEW, low water content (5–15%) cation exchange membrane which has high salt rejection, bonded to a 4 mil or so film of high ion-exchange capacity, 1100 MEW, bonded together with a Teflon cloth. One form of such a laminated construction sold by the Dupont Company is Nafion 315. Other forms of laminates or constructions in which the cathode side layer consists of a thin layer of film of low water content resin (5–15%) to optimize salt rejection are also available. Typical of such other laminates are Nafion 355, 376, 390, 227, 214. In the case of a laminated membrane bonded together by a Teflon cloth, it may be desirable to clean the membrane and Teflon cloth by refluxing it in seventy (70) percent $HNO_3$ for three to four (3 to 4) hours in addition to soaking in caustic preferred to previously.

In the case of electrolysis hydrogen halides such as hydrochloric acid, there is no problem of back migration of caustic or other salts, so that simpler forms of membranes such as Nafion 120 may be utilized as the ion transporting medium.

In the case of brine electrolysis, the cathode side barrier layer which must be characterized by low water content may include laminates in which the cathode side layer is a thin, (2–4 mil) chemically modified film of sulfonamide groups or carboxylic acid groups.

Referring now to FIG. 1, the halogen electrolysis cell is shown generally at 10 and consists of a cathode compartment 11 and an anode compartment 12 separated by a solid polymer electrolyte memberane 13 which is preferably a hydrated, permselective, cationic membrane. Bonded to opposite surfaces of membrane 13 are electrodes comprising particles of a fluorocarbon such as Teflon bonded to thermally stabilized, reduced oxides of ruthenium ($RuO_x$) or iridium ($IrO_x$), or stabilized, reduced oxides of ruthenium-iridium (RuIr), ruthenium-titanium (RuTi), ruthenium-tantalum (RuTa), ruthenium-tantalum-iridium (RuTaIr), or ruthenium-graphite or combinations of the above with graphite and other valve and transition metal oxides. The cathode, shown at 14, is bonded to and preferably embedded in one side of the membrane and a catalytic anode, not shown, is bonded to and preferably embedded in the opposite side of the membrane. Current collectors in the form of metallic screens 15 and 16 are pressed against the electrodes. The whole membrane/electrode assembly is firmly supported between the housing elements 11 and 12 by means of gaskets 17 and 18 which are made of any material resistant or inert to the cell environment, namely caustic chlorine, oxygen, aqueous sodium chloride in the case of brine electrolysis and HCl, HBr, in the case of other hydrogen halides. One form of such a gasket is a filled rubber gasket sold by Irving Moore Company of Cambridge, Mass. under its trade designation EPDM.

An aqueous alkali metal halide such as brine or hydrogen halides such as HCl is introduced through an electrolyte inlet 19 which communicates with chamber 20. Spent electrolyte and halogens such as chlorine are removed through an outlet conduit 21. A cathode inlet conduit 22 is provided in the case of brine electrolysis and communicates with cathode chamber 11 to permit the introduction of the catholyte, water, or aqueous NaOH (more dilute than that formed electrochemically at the electrode/electrolyte interface). In the case of electrolysis of hydrogen halides such as hydrogen chloride, no catholyte need be provided and the cathode inlet conduit 22 may be dispensed with.

In a brine electrolysis cell, the water serves two separate functions. A portion of the water is electrolyzed to produce hydroxyl ($OH^-$) anions which combine with the sodium cations transported across the membrane to form caustics (NaOH). The water also sweeps across the porous, bonded cathode electrode to dilute the highly concentrated caustic formed at the membrane/electrode interface to minimize diffusion of the caustic back across the membrane into the anolyte chamber. Cathode outlet conduit 21 communicates with the cathode chamber 11 to remove excess catholyte and the electrolysis products such as caustic in the case of brine electrolysis, plus any hydrogen discharge at the cathode both in brine electrolysis and in hydrogen chloride electrolysis. A power cable 24 is brought into the cathode chamber and a comparable cable not shown is brought into the anode chamber. The cables connect the current conducting screens 15 and 16 or any other suitable kind of collector as source of electrical power.

Figure 2:
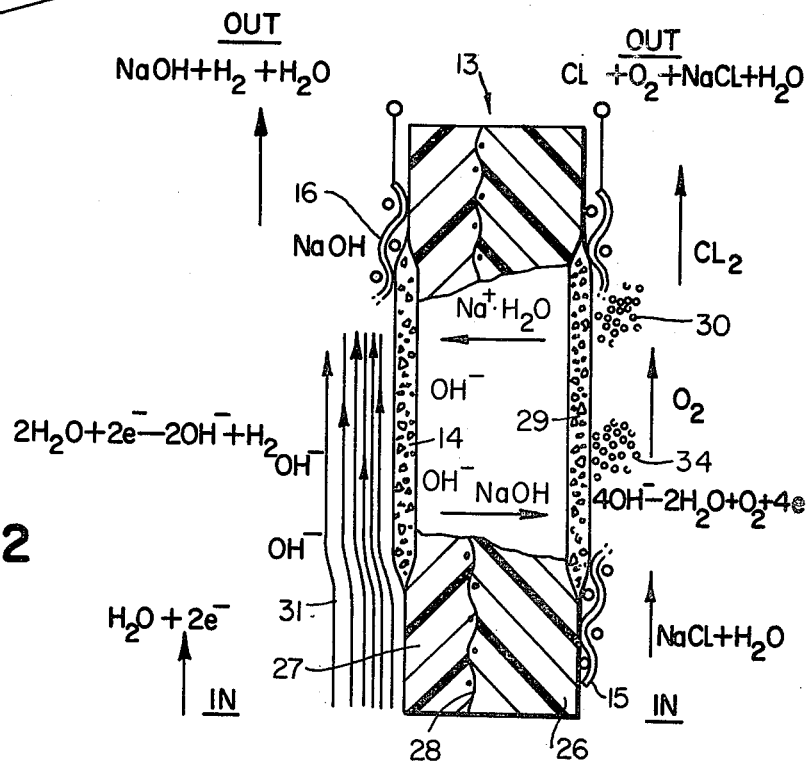
FIG. 2 is a schematic illustration showing the reactions taking place in various portions of the cell during electrolysis of an aqueous halide solution.

FIG. 2 illustrates diagrammatically the reactions taking place in the cell during the electrolysis of an aqueous alkali metal halide such as brine and is useful in understanding the electrolysis process in the manner in which the cell functions. Thus, an aqueous solution of sodium chloride is brought into the anode compartment which is separated from the cathode compartment by the cationic membrane 13. Membrane 13 is a composite membrane comprising a high water content (20–35% based on dry weight of membrane) layer 26, on the anode side and a low water content high MEW cathode side layer, (5–15% based on dry weight of membrane) separated by a Teflon cloth 28. The cathode side barrier layer may also be chemically modified on the cathode side to form a thin layer of a low water content polymer. In one form this is achieved by modifying the polymer to form a substituted sulfonamide membrane layer. By converting the cathode side layer to a weak acid form (sulfonamide), the water content of this portion of the membrane is reduced and the salt rejecting capability of the film is increased. As a result, diffusion of sodium hydroxide back across the membrane to the anode is minimized. While laminated membrane constructions are preferred in brine electrolysis to block migration of sodium hydroxide, other homogeneous films of low water content may be utilized, (viz., Nafion 150, perfluorocarboxylates, etc.). Obviously, in the case of the electrolysis of hydrogen halides such as HCl, HBr, etc., the ion transporting membrane may be a simple, homogeneous film such as the Nafion 120 referred to previously.

The Teflon-bonded, reduced noble metal oxide catalysts contains at least one thermally stabilized, reduced platinum metal oxide, such as ruthenium, iridium, or ruthenium-iridium with or without reduced oxides of titanium, niobium, or tantalum and particles of graphite are, as shown, pressed into the surface of membrane 13. Current collectors 15 and 16, shown only partially, for the sake of clarity, are pressed against the surface of the catalytic electrodes and are connected, respectively, to the positive and negative terminals of the power source to provide the electrolyzing potential across the cell electrodes. The aqueous halide ion solution, such as an aqueous sodium chloride solution, is brought into the anode chamber, is electrolyzed at anode 29 to produce chlorine as shown diagrammatically by the bubble formation 30. The chlorine actually is principally evolved at the interface of the electrode and the membrane, but passes through the porous electrode to the electrode surface. The sodium ions ($Na^+$) are transported across membrane 13 to cathode 14. A stream of water or aqueous NaOH shown at 31 is brought into the cathode chamber and acts as a catholyte. The aqueous stream is swept across the surface of the Teflon-bonded catalytic cathode 14 to dilute the caustic formed at the membrane/cathode interface and thereby reduce diffusion of the caustic back across the membrane to the anode.

A portion of the water catholyte is electrolyzed at the cathode to form hydroxyl ions and gaseous hydrogen. The hydroxyl ions combine with the sodium ions transported across the membrane to produce sodium hydroxide at the membrane/electrode interface. The sodium hydroxide readily wets the Teflon forming part of the bonded electrode and migrates to the surface where it is diluted by the aqueous stream sweeping across the surface of the electrode. Even with a cathode water sweep, concentrated sodium hydroxide in the range of 4.5–6.5M is produced at the cathode. Some sodium hydroxide, as shown by the arrow 33, does migrate back through membrane 13 to the anode. NaOH migration is a diffusion process caused by the concentration gradient and electrochemical negative ion transport to the anode. Sodium hydroxide transported to the anode is oxidized to produce water and oxygen as shown by bubble formation at 34. This of course, is a parasitic reaction which reduces the cathode current efficiency and should be minimized by the utilization of membranes which have high salt rejection characteristics on the cathode side. Aside from its effect on current efficiency, production of oxygen at the anode is undesirable since it can have troublesome effects on the electrode and membrane, particularly if the electrode includes graphite. In addition, the oxygen dilutes the chlorine produced at the anode so that processing is required to remove the oxygen. As pointed out in detail in U.S. Pat. No. 4,224,121, oxygen formation may be minimized further by acidifying the aqueous anolyte so that back migrating hydroxide is converted to water rather than generating oxygen. The reactions in various portions of the cell for electrolysis of NaCl is as follows:

| | | |
|---|---|---|
| Anode Reaction: (Principal) | $2\,Cl \rightarrow Cl_2 \uparrow + 2e^-$ | (1) |
| Membrane Transport: | $2Na^+ + H_2O$ | (2) |
| Cathode Reaction: | $2H_2O \rightarrow 2OH^- + H_2 \uparrow - 2e^-$ | (3) |
| | $2Na^+ + 2OH^- \rightarrow 2NaOH$ | (4) |
| Anode Reaction: | $4OH^- \rightarrow O_2 + 2H_2O + 4e^-$ | (5) |
| Overall (Principal) | $2NaCl + 2H_2O \rightarrow 2NaOH + Cl_2 \uparrow + H_2 \uparrow$ | (6) |

The reactions for electrolysis of a hydrogen halide, such as HCl, are very similar:

| | | |
|---|---|---|
| Anode Reaction: | $2HCl \rightarrow 2H^+ Cl_2 \uparrow + 2e^-$ | (1) |
| Membrane Transport: | $2H^+ (H_2O, HCl)$ | (2) |
| Cathode Reaction: | $2H^+ + 2e^- \rightarrow H_2 \uparrow$ | (3) |
| Overall Reaction: | $2HCl \rightarrow H_2 + Cl_2$ | (4) |

The novel arrangement for electrolyzing aqueous solutions of brine or of HCl which is described herein is characterized by the fact that the catalytic sites in the electrodes are in direct contact with the cation membrane and the ion exchanging acid radicals attached to the polymer backbone (whether these radicals are the $SO_3\,H \times H_2O$ sulfonic radicals or the $COOH \times H_2O$ carboxylic acid radicals). Consequently, there is no IR drop to speak of in the anolyte or the catholyte fluid chambers (this IR drop is usually referred to as "Electrolyte IR drop"). "Electrolyte IR drop" is characteristic of existing systems and processes in which the electrode and the membrane are separated and can be in the order of 0.2 to 0.5 volts. The elimination or substantial reduction of this voltage drop is, of course, one of the principal advantages of this invention since it has an obvious and very significant effect on the overall cell voltage and the economics of the process. Furthermore, because chlorine is generated directly at the anode and membrane interface, there is no IR drop due to the so-called "bubble effect" which is a gas blending and mass transport loss due to the interruption or blockage of the electrolyte path between the electrode and the membrane. As pointed out previously, in prior art systems, the chlorine discharging catalytic electrode is separated from the membrane. The gas is formed directly at the electrode and results in a gas layer in the space between the membrane and the electrode. This in effect breaks up the electrolyte path between the electrode-collector and the membrane blocking passage of $Na^+$ ions and thereby, in effect, increasing the IR drop.

In a preferred embodiment, the Teflon-bonded noble metal electrode contains reduced oxides of ruthenium, iridium or ruthenium-iridium in order to minimize chlorine overvoltage at the anode. The reduced ruthenium oxides are stabilized against chlorine and oxygen evolution to produce an anode which is stable. Stabilization is effected initially by temperature stabilization; i.e., by heating the reduced oxides of ruthenium for one hour at temperatures in the range of 550° to 600° C. The Teflon-bonded reduced oxides of ruthenium anode is further stabilized by mixing it with graphite and/or alloying or mixing with reduced oxides of iridium $(Ir)O_x$ in the range of 5 to 25% of iridium, with 25% being preferred, or with reduced oxides of titanium $(Ti)O_x$, with 25–50% of $TiO_x$ preferred. It has also been found that a ternary alloy of reduced oxides of titantium, ruthenium and iridium $(Ru, Ir, Ti)O_x$ or tantalum, ruthenium and iridium $(Ru, Ir, Ta)O_x$ bonded with Teflon is very effective in producing a stable, long-lived anode. In case of the ternary alloy the composition is preferably 5% to 25% by weight of reduced oxides of iridium, approximately 50% by weight reduced oxides of ruthenium, and the remainer a transition metal such as titanium. For a binary alloy of reduced oxides of ruthenium and titanium, the preferred amount is 50% by weight of titanium with the remainder ruthenium. Titanium, of course, has the additional advantage of being much less expensive than either ruthenium or iridium, and thus is an effective extender which reduces cost while at the same time stabilizing the electrode in an acid environment and against HCl, chlorine and oxygen evolution. Other transition metals, such as niobium (Nb), tantalum (Ta), zirconium (Zr) or hafnium (Hf) can readily be substituted for Ti in the electrode structures. In addition to transition metals, transition metal carbides, nitrides and sulfides may also be utilized as catalyst extenders.

The alloys of the reduced noble metal oxides along with the reduced oxides of titanium or other transition metals are blended with Teflon to form a homogeneous mix. The anode Teflon content may be 15 to 50% by weight of the Teflon, although 20 to 30% by weight is preferred. The Teflon is of the type as sold by the DuPont Corporation under its designation T-30, although other fluorocarbons may be used with equal facility. Typical noble metal, etc., loadings for the anode are 0.6 $mg/cm^2$ of the electrode surface with the preferred range being 1–2 $mg/cm^2$. The current collector for the anode electrode may be a platinized niobium screen of fine mesh which makes good contact with the electrode surface. Alternatively, an expanded titanium screen coated with ruthenium oxide, iridium oxide, transition metal oxide and mixtures thereof may also be used as an anode collector structure. Yet another anode collector structure may be in the form of a titanium-palladium plate with a platinum clad screen attached to the plate by welding or bonding.

The cathode is preferably a bonded mixture of Teflon particles and platinum black with platinum black loading of 0.4 to 4 $mg/cm^2$. The cathode electrode, like the anode, is bonded to and embedded in the surface of the cation membrane. The cathode is made quite thin, 2–3 mils or less, and preferably approximately 0.5 mils, is porous and has a low Teflon content.

The thickness of the cathode can be quite significant in that it can be reflected in reduced water of aqueous NaOH sweeping and penetration of the cathode and thus reduces cathodic current efficiency. Cells were constructed with thin (approximately 0.5 to 2.0 mil) pt black-15% Teflon bonded cathodes. The current efficiencies of thin cathode cells were approximately 80% at 5M NaOH when operated at 88°–91° C. with a 290 g/L NaCl anode feed. With a 3.0 mil Ru-graphite cathode, the current efficiency was reduced to 54% at 5M NaOH. Table A shows the relationship to CE to thickness, and indicates that thicknesses not exceeding 2–3 mils give the best performance.

TABLE A

| Cell | Cathode | Cathode Thickness (mil) | Current Efficiency % (M NaOH) |
|---|---|---|---|
| 1 | Pt Black | 2–3 | 64 (4.0 M) |
| 2 | Pt Black | 2–3 | 73 (4.5 M) |
| 3 | Pt Black | 1–2 | 75 (3.1 M) |
| 4 | Pt Black | 1–2 | 82 (5 M) |
| 5 | Pt Black | 0.5 | 78 (5.5 M) |
| 6 | 5% Pt Black on Graphite | 3 | 78 (3.0 M) |
| 7 | 15% Ru $O_x$ on Graphite | 3 | 54 (5.0 M) |
| 8 | Platinized Graphite Cloth | 10–15 | 57 (5 M) |

The electrode is made gas permeable to allow gases evolved at the electrode/membrane interface to escape readily. It is made porous to allow penetration of the sweep water to the cathode electrode/membrane interface where the NaOH is formed and to allow brine feedstock ready access to the membrane and the electrode catalytic sites. The former aids in diluting the highly concentrated NaOH when initially formed before the NaOH wets the Teflon and rises to the electrode surface to be further diluted by water sweeping across the electrode surface. It is important to dilute at the membrane interface where the NaOH concentration is the greatest. In order to maximize water penetration at the cathode, the Teflon content should not exceed 15% to 30% weight, as Teflon is hydrophobic. With good porosity, a limited Teflon content, a thin cross-section, and a water or diluted caustic sweep, the NaOH concentration is controlled to reduce migration of NaOH across the membrane.

The current collector for the cathode must be carefully selected since the highly corrosive caustic present at the cathode attacks many materials, especially during shutdown. The current collector may take the form of a nickel screen since nickel is resistant to caustic. Alternatively, the current collector may be constructed of a stainless steel plate with a stainless steel screen welded to the plate. Another cathode current structure which is resistant to or inert in the caustic solution is graphite or graphite in combination with a nickel screen pressed to the plate and against the surface of the electrode.

EXAMPLES

Cells incorporating ion exchange membranes having Teflon-bonded reduced noble metal oxide electrodes embedded in the membrane were built and tested to illustrate the effect of various parameters on the effectiveness of the cell in brine electrolysis and to illustrate particularly the operating voltage characteristics of the cell.

Table I illustrates the effect on cell voltage of the various combinations of the reduced noble metal oxides. Cells were constructed with electrodes containing various specific combinations of reduced nobel metal oxides bonded to Teflon particles and embedded into a cationic membrane 6 mils thick. The cell was operated with a current density of 300 amperes per square foot at 90° C., at feed rates of 200 to 2000 CC per minute, with feed concentration of 5M.

One cell was constructed in accordance with the teachings of the prior art and contained a dimensionally stabilized anode spaced from the membrane and a stainless steel cathode screen similarly spaced. This control cell was operated under the same conditions.

It can readily be observed from this data that in the process of the instant invention, the cell operating potentials are in the range of 2.9–3.6 volts. When compared to a typical prior art arrangement (Control Cell No. 4), under the same operating conditions, a voltage improvement of 0.6 V–1.5 V is realized. The operating efficiencies and economic benefits which result are clearly apparent.

TABLE I

| Cell No. | Anode | Cathode | Brine Feed | Current Density (ASF) | Cell Voltage (V) | t.° - C.° | C.E. | Membrane (5M NaOH) |
|---|---|---|---|---|---|---|---|---|
| 1 | 6 Mg/Cm$^2$ (Ru 25% Ir)Ox | 4 Mg/Cm$^2$ Pt Black | ~5 M (290 g/L) | 300 | 3.2–3.3 | 90° | 85% | DuPont Nafion 315 Laminate |
| 2 | 6 Mg/Cm$^2$ (Ru 25% Ir)Ox | 4 Mg/Cm$^2$ Pt Black | ~5 M (290 g/L) | 300 | 3.3–3.6 | 90° | 78% | DuPont 1500 EW Nafion |
| 3 | 6 Mg/Cm$^2$ (Ru 25% Ir)Ox | 4 Mg/Cm$^2$ Pt Black | ~5 M (290 g/L) | 300 | 2.9 | 90° | 66% | DuPont 1500 EW Nafion |
| 4 | Dimensionally Stable Screen Anode - Spaced from Membrane | Stainless Steel Screen Spaced from Membrane | ~5 M (290 g/L) | 300 | 4.2–4.4 | 90° | 81% | DuPont 1500 EW Nafion |
| 5 | 4 Mg/Cm$^2$ (Ru 50% Ti)Ox | 4 Mg/Cm$^2$ Pt Black | ~5 M (290 g/L) | 300 | 3.6–3.7 | 90° | 85% | DuPont Nafion 315 Laminate |
| 6 | 4 Mg/Cm$^2$ (Ru 25% Ir - 25% Ta)Ox | 4 Mg/Cm$^2$ Pt Black | ~5 M (290 g/L) | 300 | 3.5–3.6 | 90° | 86% | DuPont Nafion 315 Laminate |
| 7 | 6 Mg/Cm$^2$ (Ru Ox-Graphite) | 2 Mg/Cm$^2$ Pt Black | ~5 M (290 g/L) | 300 | 3.0 | 90° | 89% | DuPont Nafion 315 Laminate |
| 8 | 6 Mg/Cm$^2$ (Ru Ox) | 4 Mg/Cm$^2$ Pt Black | ~5 M (290 g/L) | 300 | 3.4 | 80° | 83% | DuPont 1500 EW Nafion |
| 9 | 6 Mg/Cm$^2$ (Ru - 5 Ir)Ox | 4 Mg/Cm$^2$ Pt Black | ~5 M (290 g/L) | 300 | 3.4–3.7 | 90° | 73% | DuPont 1500 EW Nafion |
| 10 | 2 Mg/Cm$^2$ (Ir Ox) | 4 Mg/Cm$^2$ Pt Black | ~5 M (290 g/L) | 300 | 3.1–3.5 | 90° | 80% | DuPont Nafion 315 Laminate |
| 11 | 2 Mg/Cm$^2$ (Ir Ox) | 4 Mg/Cm$^2$ Pt Black | ~5 M (290 g/L) | 300 | 3.2–3.6 | 90° | 65% | DuPont Nafion 315 Laminate |

A cell similar to Cell No. 7 of Table I was constructed and operated at 90° C. in a saturated brine feed. The cell potential (V) as a function of current density (ASF) was observed and is shown in Table II.

TABLE II

| Cell Voltage (V) | Current Density (ASF) |
|---|---|
| 3.2 | 400 |
| 2.9 | 300 |
| 2.7 | 200 |

TABLE II-continued

| Cell Voltage (V) | Current Density (ASF) |
|---|---|
| 2.4 | 100 |

This data shows that cell operating potential is reduced as current density is reduced. Current density vs. cell voltage is, however, a trade-off between operating and capital costs of a chlorine electrolysis. It is significant, however, that even at very high current densities (300 and 400 ASF), significant improvements (in the order of a volt or more) in cell voltages are realized in the chloride generating process of the instant invention.

Table III illustrates the effect of cathodic current efficiency on oxygen evolution. A cell having Teflon-bonded reduced noble metal oxides catalytic anodes and cathodes embedded in a cationic membrane were operated at 90° C. with a saturated brine concentration, with a current density of 300 ASF and a feed rate of 2–5 CC/Min/in$^2$ of electrode area. The volume percent of oxygen in the chlorine was determined as a function of cathodic current efficiency.

TABLE III

| Cathodic Current Efficiency (%) | Oxygen Evolution (Volume %) |
|---|---|
| 89 | 2.2 |
| 86 | 4.0 |
| 84 | 5.8 |
| 80 | 8.9 |

Table IV illustrates the controlling effect that acidifying the brine has on oxygen evolution. The volume percent of oxygen in the chlorine was measured for various concentration of HCl in the brine.

TABLE IV

| Acid (HCl) Concentration (M) | Oxygen Volume % |
|---|---|
| 0.05 | 2.5 |
| 0.75 | 1.5 |
| 0.10 | 0.9 |
| 0.15 | 0.5 |

TABLE IV-continued

| Acid (HCl) Concentration (M) | Oxygen Volume % |
|---|---|
| 0.25 | 0.4 |

It is clear from this data that oxygen evolution due to electrochemical oxidation of the back migrating $OH^-$ is reduced by preferentially reacting the $OH^-$ chemically with $H^+$ to form $H_2O$.

A cell similar to Cell No. 1 of Table I was constructed and operated with a saturated NaCl feedstock acidified with 0.2M HCl and at 300 ASF. The cell voltage was measured at various operating temperatures from 35°-90° C.

A cell similar to Cell No. 7 of Table I was constructed and operated with 290 g/L (~5M)/L NaCl stock (not acidified) at 200 ASF. The cell voltage was measured at various operating temperatures from 35°-90° C. The data was normalized for 300 ASF.

TABLE V

| Cell No. 1 Voltage | Cell No. 7 Voltage Normalized to 300 ASF (200 ASF Data) | Temperature °C. |
|---|---|---|
| 3.65 | 3.50 (3.15) | 35° |
| 3.38 | 3.30 (2.98) | 45° |
| 3.2 | 3.20 (2.9) | 55° |
| 3.15 | 3.12 (2.78) | 65° |
| 3.10 | 3.05 (2.72) | 75° |
| 3.05 | 2.97 (2.65) | 85° |
| 3.02 | 2.95 (2.63) | 90° |

This data shows that the best operating voltage is obtained in the 80°-90° range. It is to be noted, however, that even at 35° C., the voltage with the instant catalyst and electrolyzer is at least 0.5 volts better than prior art chlorine electrolyzers operating at 90° C.

When the NaCl electrolysis is carried out in a cell in which both electrodes are bonded to the surface of an ion transporting membrane, the maximum improvement is achieved. However, improved process performance is achieved for all structures in which at least one of the electrodes is bonded to the surface of the ion transporting member (hybrid cell). The improvement in such a hybrid structure is somewhat less than is the case with both electrodes bonded. Nevertheless, the improvement is quite significant (0.3-0.5 volts better than the voltage requirements for known processes).

A number of cells were constructed and brine electrolysis carried out to compare the results in a fully bonded cell (both electrodes) with the results in hybrid cell constructions (anode only bonded and cathode only bonded) and with the results a prior art non-bonded construction (neither electrode bonded). All of the cells were constructed with membranes of Nafion 315, the cell was operated at 90° C. with a brine feedstock of approximately 290 g/L. The bonded electrode catalyst loadings were 2 g/ft$^2$ at the cathode for Pt Black and 4 g/ft$^2$ at the anode for $RuO_x$-graphite and $RuO_x$. The current efficiency at 300 ASF was essentially the same for all cells (84-85% for 5M NaOH). Table VI shows the cell voltage characteristics for the various cells:

TABLE VI

| Cell | Anode | Cathode | Cell Voltage (V) at 300 ASF |
|---|---|---|---|
| 1 | Ru-Graphite (Bonded) | Pt Black (Bonded) | 2.9 |
| 2 | Platinized Niobium Screen (Not Bonded) | Pt Black (Bonded) | 3.5 |
| 3 | Platinized Niobium Screen (Not Bonded) | Pt Black (Bonded) | 3.4 |
| 4 | Ru-Graphite (Bonded) | Ni Screen (Not Bonded) | 3.5 |
| 5 | Ru $O_x$ (Bonded) | Ni Screen (Not Bonded) | 3.3 |
| 6 | Platinized Niobium Screen (Not Bonded) | Ni Screen (Not Bonded) | 3.8 |

It can be seen that the cell voltage of the fully Teflon-bonded cell No. 1 is almost a volt better than the voltage for the prior art, completely non-Teflon bonded, control cell No. 6. Hybrid cathode bonded cells 2 and 3 and hybrid anode bonded cells 4 and 5 are approximately 0.4-0.6 volts worse than the fully Teflon-bonded cell but still 0.3-0.5 volts better than the prior art processes which are carried out in a cell without any Teflon bonded electrodes.

It will be appreciated that a vastly superior process for generating chlorine and other halides from brine and, as will be shown hereafter, from HCl and other halides, has been made possible by reacting the anolyte and the catholyte at catalytic electrodes bonded directly to and embedded in the cationic membrane. By virtue of this arrangement, the catalytic sites in the electrodes are in direct contact with the membrane and the acid exchanging radicals in the membrane resulting in a much more voltage efficient process in which the required cell potential is significantly better (up to a volt or more) than known processes. The use of highly effective fluorocarbon bonded thermally stabilized, reduced noble metal oxide catalysts, as well as fluorocarbon graphite-reduced noble metal oxide catalysts with low overvoltages, further enhance the efficiency of the process.

EXAMPLES

Electrodes containing thermally stabilized, reduced noble metal oxides, etc., embedded in ion-exchange membranes were built and tested to illustrate the effect of various parameters on the effectiveness of the cell and catalyst in the electrolysis of hydrochloric acid.

Table VII illustrates the Effect on Cell Voltage of various combinations of reduced noble metal oxides. Cells were constructed with Teflon-bonded, graphite electrodes containing various specific combinations of thermally stabilized, reduced platinum metal oxides and reduced oxides of titanium embedded into a hydrated cationic membrane, 12 mils thick. The cell was operated with a current density of 400 amps per square, at 30° C., at a feed rate of 70 cc per minutes, (0.05 ft$^2$ active cell area) with feed normalities of 9=11N.

Tables VIII and IX illustrate the effect of time for the same cells and under the same conditions, on cell operating voltages.

Table X shows the effect of acid feed concentration ranging from 7.5-10.5N. A cell, like cell No. 5 in Table II, was constructed with reduced (Ru, 25% Ir)$O_x$ noble metals added to the Teflon-bonded graphite electrode. The cell was operated at fixed feed rate of 150 cc/min, (0.05 ft$^2$ active cell area) at 30° C. and 400 ASF.

TABLE VII

| Cell No. | Operational Time (Hrs.) | Anode - Graphite/ Fluorocarbon Plus | Loading ($Mg/Cm^2$) | Cathode - Graphite/ Fluorocarbon Plus | Loading ($Mg/Cm^2$) | Feed Normality (Eq/L) | Current Density - Amperes/Sq. Ft. (ASF) | Cell Voltage (V) |
|---|---|---|---|---|---|---|---|---|
| 1 | 6300 | (Ru)Ox Heat Stabilized | 0.6 | (Ru)Ox Heat Stabilized | 0.6 | 9–11 | 400 | 2.10 |
| 2 | 5300 | (Ru Ti)Ox Heat Stabilized | 0.6 | (Ru Ti)Ox Heat Stabilized | 0.6 | " | 400 | 2.01 |
| 3 | 4900 | (Ru Ti)Ox Heat Stabilized | 1.0 | (Ru Ti)Ox Heat Stabilized | 1.0 | " | 400 | 1.97 |
| 4 | 1800 | (Ru Ti)Ox Heat Stabilized | 1.0 | (Ru)Ox Heat Stabilized | 1.0 | " | 400 | 1.91 |
| 5 | 4000 | (Ru 25% IrO Heat Stabilized | 1.0 | (Ru 25% Ir)Ox Heat Stabilized | 1.0 | " | 400 | 2.07* (1.9) |
| 6 | 200 | (Ru,Ti,5% Ir)Ox Heat Stabilized | 2.0 | (Ru,Ti,5% Ir)Ox Heat Stabilized | 2.0 | " | 400 | 1.80 |
| 7 | 100 | (Ru-25% Ta)Ox | 2.2 | (Ru, 25% Ta)Ox | 2.0 | " | 400 | 1.64 |

*Performance of this cell at 3800 hours was approximately 1.9V. Taken off test due to cell leakage

TABLE VIII

| Cell No. | Cell Voltage (V) at 100 Hrs. Operating Time | Cell Voltage (V) At Operating Time From Table I | Current Density Amperes Per Square Foot (ASF) |
|---|---|---|---|
| 1 | 1.85 | 2.10 | 400 |
| 2 | 1.84 | 2.01 | 400 |
| 3 | 1.78 | 1.97 | 400 |
| 4 | 1.80 | 1.91 | 400 |
| 5 | 1.75 | 2.07* (1.9) | 400 |
| 6 | 1.70 | 1.80 | 400 |

*See note for Table VII

TABLE IX

| Cell No. | Intermediate Operating Time - (Hrs.) | Current Density Amperes/Sq. Ft. (ASF) | Cell Voltages (V) |
|---|---|---|---|
| 1 | 3900 | 100 | 1.70 |
| | | 200 | 1.93 |
| | | 300 | 2.00 |
| 2 | 3400 | 100 | 1.57 |
| | | 200 | 1.70 |
| | | 300 | 1.83 |
| 3 | 1900 | 100 | 1.58 |
| | | 200 | 1.70 |
| | | 300 | 1.81 |
| 4 | 1000 | 1000 | 1.47 |
| | | 2000 | 1.60 |
| | | 300 | 1.72 |
| 5 | 1200 | 100 | 1.32 |
| | | 200 | 1.45 |
| | | 300 | 1.55 |

TABLE X

| Feed Normality (eQ/L) | Volume % $O_2$ |
|---|---|
| 7 | 0.4 |
| 7.5 | 0.15 |
| 8 | 0.04 |
| 8.5 | 0.015 |
| 10 | 0.007 |
| 10.5 | 0.004 |
| 11.5 | 0.003 |

From the above examples, it will be clear that HCl is electrolyzed to produce chlorine gas, substantially free of oxygen. The catalyst used in the electrolyzer cell is characterized by low cell voltage and low temperature (~30° C.) operation resulting in economical operation of such electrolyzer cells. Furthermore, this data shows excellent performance at various current densities, particularly at 300–400 ASF. This has a positive and beneficial effect on capital costs for chlorine electrolyzers embodying the instant invention.

To show the effect of thermal stabilization on reduced noble metal and transition metal oxides, certain tests were carried out. These tests show the impact on the resistance of the catalyst to harsh electrolysis environments. Thermally stabilized as well as non-stabilized, reduced oxide catalysts were exposed to highly concentrated HCl solutions which represent extremely harsh environmental conditions. The color of the solution was observed since darkening of the solution indicated loss of catalyst. Increasing loss of catalyst was accompanied by more pronounced color changes.

Table XI shows the results of these corrosion resistance and stability tests for catalyst batches ranging from 0.5 to 20 gms.

TABLE XI

| Catalyst | Treatment | Temp. °C. | Corrosion Medium | Time (Hours) | Observation (Color) | Stability Evaluation |
|---|---|---|---|---|---|---|
| Ru $O_x$ | None | 24° C. | 12N HCl | 24 | Light Brown Color | Modest Corrosion |
| | Thermally Stabilized 550° C. for one (1) Hour | 24° C. | 12N HCl | 744 | Very Pale Yellow | Very Little Corrosion Good Stability |
| (Ru 25Nb)$O_x$ | None | 24° C. | 12N HCl | 24 912 | Light Brown Amber | Modest Corrosion |
| (Ru 50Ta)$O_x$ | None | 24° C. | 12N HCl | 168 | Pale Amber | Modest Corrosion |
| | 550° C. for one (1) Hour | 24° C. | 12N HCl | 96 | Very Pale Yellow | Fully Stable |
| | 550° C. for one (1) More Hour | | | 72 | No Change in Color | |
| (Ru 5Ir)$O_x$ | None | 24° C. | 12N HCl | 168 | Amber | Substantial Corrosion Unstable |
| | 550° C. for one (1) Hour | 24° C. | 12N HCl | 96 | No Change in Color | Fully Stable |

TABLE XI-continued

| Catalyst | Treatment | Temp. °C. | Corrosion Medium | Time (Hours) | Observation (Color) | Stability Evaluation |
|---|---|---|---|---|---|---|
| (Ru 25Ir)$O_x$ | None | 24° C. | 12N HCl | 168 | Amber | Substantial Corrosion Unstable |
| | 550° C. for one (1) Hour | 24° C. | 12N HCl | 96 | Very Pale Yellow | Fully Stable |
| | 550° C. for one (1) More Hour | 24° C. | 12N HCl | 72 | No Color Change | |

It will be obvious from this data that thermal stabilization of the rereduced oxides enhances the corrosion resistance of the catalyst in very concentrated HCl and, in fact, provides very good stability. It is obvious that resistance of the catalysts in the much less corrosive chlorine or brine environments is excellent and attributable to thermal stabilization of the reduced oxide catalyst.

Having observed the improved corrosion characteristics of the thermally stabilized, reduced, platinum group metal oxides, physical and chemical tests were conducted to determine the effect of thermal stabilization on various characteristics of the catalysts which might account for the improved corrosion characteristics. The oxide content, surface area in $M^2/g$ of catalyst, the pore volume and pore size distribution of the catalyst were measured after fabrication of the catalyst by the modified Adams method; after reduction of the catalyst; and after thermal stabilization of the reduced catalyst. The result of these tests, which will be set forth in detail below, show that the surface area of the catalyst is reduced somewhat after the catalyst is reduced, and quite substantially after thermal stabilization. A drop in oxide content after the reduction step is believed to account for part of the decrease of the surface area. A substantial change in the internal pore size distribution of the catalyst after thermal stabilization without a corresponding change in the pore volume is believed responsible for the very substantial decrease (ratio of 2 to 1) in surface area accompanying thermal stabilization and would account for the improved corrosion characteristics as corrosion is directly related to the area exposed to attack by any corrosive agents.

Initially, Sample #1, a ruthenium-25% by weight iridium catalyst was prepared by the modified Adams method. A portion of this catalyst was reduced electrochemically to form Sample #2. A reduced (Ru 25 Ir)$O_x$ sample was thermally stabilized for one (1) hour at 550°-600° C. The surface area of the unreduced (Sample #1) catalyst, the reduced catalyst (Sample #2) and the thermally stabilized, reduced (Ru 25 Ir)$O_x$ catalyst (Sample #3), as measured by the three point BET (BRUNAUER-EMMET-TELLER) nitrogen adsorption method, is shown in Table XII.

TABLE XII

| Catalyst (Ru 25 Ir) | Treatment | Surface Area |
|---|---|---|
| Sample #1 | None | 127.6 $M^2/g$ |
| Sample #2 | Reduced | 123.5 $M^2/g$ |
| Sample #3 | Reduced and Thermal Stabilization - 550-600° C.; One (1) Hour | 62.3 $M^2/g$ |

The oxide content of Samples #1, #2, and #3 was then measured as well as that of a Sample (#4) thermally stabilized at 700°-750° C. for one (1) hour. In addition the oxide content of Pt Ir catalysts containing respectively 5 and 50% by weight if Iridium was measured. The results are shown in Table XIII.

TABLE XIII

| Catalyst (Ru 25 Ir) | Treatment | % Oxide Content |
|---|---|---|
| Sample #1 | None | 24.4 |
| Sample #2 | Reduction | 24.3 |
| Sample #3 | Thermal Stabilization; 550-600° C. - One (1) Hour | 22.6 |
| Sample #4 | Reduction and Thermal Stabilization; 700-750° C. - One (1) Hour | 21.5 |
| (Pt-50ir) | | |
| Sample #5 | None | 16.5 |
| Sample #6 | Reduction | 15.2 |
| Sample #7 | Reduction and Thermal Stabilization; 550-600° C. - One (1) Hour | 13.0 |

The data from Table XIII shows a decrease in oxide content with reduction and thermal stabilization just as surface area decreases after reduction and thermal stabilization.

Decrease of oxide content (i.e., unreduced catalyst) will have a corresponding effect on surface area since the surface area of oxides is normally greater than that of the non-oxide form. This reduction in oxide content in part explains surface area reduction but does not wholly explain the dramatic reduction in surface area after thermal stabilization.

The porosity of the catalyst was therefore measured to determine whether thermal stabilization of the catalyst causes a change in porosity thereby decreasing the surface area and increasing its corrosion resistance. Catalyst samples were taken from the same batches as Samples #1, #2 and #, 3 and the porosity of the samples and particle size distribution measured. Particle size distribution was measured by a sedimentation method and showed that the equivalent spherical diameter at 50% mass distribution was 3.7 microns ($\mu$) after reduction of the catalyst and 3.1 microns ($\mu$) after thermal stabilization. This indicates that the external surface of the particles is reduced but again does not account for all of the surface area reduction after stabilization.

Total pore volume data (cc/g) was obtained by capillary condensation and mercury intrusion methods. Data for Samples #1, #2 and #3 and is shown in Table XIV.

TABLE XIV

| Catalyst (Ru - 25 Ir) | Treatment | Range | Total Pore Volume cc/g |
|---|---|---|---|
| Sample #1 | None | 40A-10$\mu$ | 0.80 cc/gm |
| Sample #2 | Reduction | " | 0.72 cc/gm |
| Sample #3 | Reduction and Thermal Stabilization; 500-600° C. - | " | 0.76 cc/gm |

TABLE XIV-continued

| Catalyst (Ru - 25 Ir) | Treatment | Range | Total Pore Volume cc/g |
|---|---|---|---|
| | One (1) Hour | | |

The data shows that the total pore volume is relatively unchanged. Thus the porosity, in terms of gms/cc or if converted to void volume (knowing the spherical size and density), is essentially the same and is in the range of 0.7–0.8 gms/cc for Ru-25 Ir.

Simultaneously, the pore size distribution as measured to obtain the pore diameter distributions in the 40 A°–10 micron range. Capillary condensation was used in the 40–500 A° range. In this method liquid condensation for a given vapor pressure is measured to obtain pore size distribution. The capillary condensation method has a lower resolution limit of 40 A° and an upper limit of 500 A°. For pores in excess of 500 A° (i.e., 500 A°–10μ) a mercury intrusion method is utilized to obtain pore sice distribution. Pore diameter distribution measurements for the two ranges is shown in Tables XV and XVI respectively.

TABLE XV

| Catalyst | Treatment | Size Range | Pore Diameter Distribution |
|---|---|---|---|
| Sample #1 | None | 40–500 A° | Pore Distribution below 40 A° |
| Sample #2 | Reduction | " | Pore diameter distribution below 40 A° |
| Sample #3 | Reduction and Thermal Stabilization; 550–600° C.; One (1) Hour | " | Distribution in the range of 100–300 A° with maximum at 200 A° |

TABLE XVI

| Catalyst | Treatment | Size Range | Pore Diameter Distribution (50% point in distribution) |
|---|---|---|---|
| Sample #1 | None | 500 A°–10 microns | 0.46μ |
| Sample #2 | Reduction | " | 0.82μ |
| Sample #3 | Reduction and Thermal Stabilization; 500–600° C.; One (1) Hour | " | 1.5μ |

This data indicates that thermal stabilization of the catalyst results in a change in pore size diameter. This change seems to be accompanied by a change in the number of pores so that the overall surface area decreases. With the pore volume staying substantially constant and the pore diameter distribution changing so that the distribution shows a maximum at 200 A°, and 1.5μ it seems quite clear that many of the pores below 40 A° coalesce, reducing the overall number of pores. Above 500 A° the pore diameter increases. The pore size diameter and internal pore surface area thus changes with thermal stabilization. In summary, the internal porosity and thus the pore surface area is reduced as the catalyst is thermally stabilized. It is believed that this is a result of changing the morphology to provide a smaller number of pores with a larger pore diameter distribution. With the pore volume relatively unchanged and a change in pore diameter distribution to a larger pore diameter, it seems clear that the surface area reduction associated with thermal stabilization of the catalyst is attributable to the change in internal pore surface area.

The porosity (in terms of pore volume (cc) per unit weight (g) of catalyst) of the thermally stabilized, reduced platinum metal oxide catalyst lies in the 0.4–1.5 cc/gm range with the preferred porosity for a thermally stabilized Ru-25 Ir catalyst being 0.7–0.8 cc/gm.

The pore diameter distribution of the thermally stabilized catalyst shows the principal distribution below 500 A° in the 100–300 A° range, with a maximum at 200 A°. Above 500 A° the pore diameter distribution shows the greatest pore volume and hence the principal distribution is in 0.04–9μ range with a maximum at 1.5μ's (representing the 50% point in distribution).

The catalyst surface area range for thermally stabilized, reduced platinum metal oxide catalysts should be such that for any given platinum metal, or combination of platinum metals with or without transition metals, etc., the surface area should be as low as possible (to reduce corrosion) for the required catalytic activity. Thus, the surface area should be in excess of $10M^2/gm$ ranges from $24–165M^2/g$, with a preferred range being from $24–165M^2/g$ and from $60–70M^2/g$ for a thermally stabilized Ru-25 Ir catalyst. The reduced, thermally stabilized platinum group metal oxide catalysts are, as may be seen, large surface area catalyst as compared to powders, blacks, etc., which normally have surface areas around $10–15M^2/g$.

The oxide content of the catalyst can range from 2–25% by weight, with the preferred range being 13 to 23% by weight.

While the instant invention has been shown in connection with a preferred embodiment thereof, the invention is by no means limited thereto, since other modifications of the instrumentalities, material and articles employed may be made and fall within the true scope and spirit of this invention.

What is claimed as new and desired to be secured by Letters Patent of the United States is:

1. In a combination membrane and electrode structure for electrolytic production of halogens comprising a gas and hydraulically impervious polymeric ion transporting membrane having at least one gas and liquid permeable catalytic electrode bonded to a surface of the membrane to form a unitary electrode membrane structure, the improvement which comprises a bonded electrode including partially reduced oxides of at least one platinum group metal taken from the group consisting of platinum, iridium, ruthenium, paladium, and osmium and alloys thereof and optionally containing graphite heated in the presence of oxygen at a temperature high enough to stabilize the reduced oxides thermally against corrosion.

2. The membrane and electrode structure according to claim 1 wherein the electrode includes electroconductive, partially reduced oxide of a platinum group metal heated in the presence of oxygen at a temperature between 350°–750° C. to stabilize the partially reduced oxides against corrosive halide electrolysis conditions.

3. The membrane and electrode stucture according to claim 2 wherein the electrode comprises a plurality of oxide particles are bonded together by polymeric particles and include thermally stabilized partially reduced oxides of said platinum group metals and a thermally stabilized, partially reduced valve metal oxide taken from the group consisting of tantalum, titanium, niobium, zirconium and hafnium, with at least one kind being a thermally stabilized partially reduced plantinum group metal oxide.

4. The membrane and electrode structure according to claim 3 wherein said particles include thermally stabilized, electroconductive, partially reduced oxides of ruthenium.

5. The membrane and electrode structure according to claim 4 wherein the thermally stabilized, electroconductive particles are thermally stabilized reduced oxides of ruthenium and reduced oxides of iridium.

6. The membrane and electrode structure according to claim 5 wherein the particles include 5% to 25% by weight of partially reduced oxides of iridium.

7. The membrane and electrode structure according to claim 2 wherein the particles include 25% by weight of iridium and the oxide content is from 2–25 weight percent of the particles.

8. The membrane and electrode structure according to claim 3 wherein the plurality of particles include thermally stabilized, electroconductive particles of partially reduced platinum group metal oxides and thermally stabilized partially reduced oxides of a valve metal.

9. The membrane and electrode structure according to claim 8 wherein the thermally stabilized, partially reduced platinum group metal oxide is partially reduced ruthenium oxide.

10. The membrane and electrode according to claim 7 wherein the partially reduced platinum group metal oxide is partially reduced iridium oxide.

11. The membrane and electrode structure according to claim 5 wherein the thermally stabilized, electroconductive particles include thermally stabilized, partially reduced valve metal oxides.

12. In a combination membrane and electrode structure for halogens comprising an ion transporting membrane having at least a gas permeable anode electrode bonded to one surface of said membrane the improvement which comprises an anode electrode which includes electroconductive, catalytically active, partially reduced oxide particles of at least one platinum group metal treated in the presence of oxygen at a temperature high enough to stabilize the partially reduced oxide particles thermally with the surface area of the electrodes after stabilization being at least 60 square meters per gram of particle and the pore diameter distribution of said thermally stabilized oxides has maxima centered at 200 A and a 50% pore distribution point at 1.5 Microns.

13. A process for the preparation of a halogen evolving electrocatalyst comprising the steps of forming oxides of at least one platinum group metal optionally containing a valve metal oxide, reducing the said oxides to a partially oxidized state, thereafter heating the partially reduced oxides in the presence of oxygen at a temperature and a duration sufficient to stabilize said partially reduced oxides to increase its corrosion resistance in the presence of halogens, and optionally adding up to 50% by weight of graphite.

14. The process according to claim 13 wherein the partially reduced oxides are heated at 300° to 750° C.

15. The process according to claim 14 wherein the partially reduced oxides are heated for one hour at 550° to 600° C.

16. The membrane and electrode structure according to claim 2 wherein the pore diameter distribution of the thermally stabilized, partially reduced platinum group metal oxide has pore diameter distribution maxima centered at 200 A° and a 50% pore distribution point at 1.5 Microns.

* * * * *